US011168417B2

(12) United States Patent
Oordt et al.

(10) Patent No.: US 11,168,417 B2
(45) Date of Patent: Nov. 9, 2021

(54) ARTICLE OF FOOTWEAR INCORPORATING KNITTED COMPONENTS AND A RECEIVING STRAP COMPONENT

(71) Applicant: NIKE, Inc., Beaverton, OR (US)

(72) Inventors: Latane Oordt, Portland, OR (US); Martin Vasilevski, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 171 days.

(21) Appl. No.: 16/507,620

(22) Filed: Jul. 10, 2019

(65) Prior Publication Data

US 2020/0022457 A1 Jan. 23, 2020

Related U.S. Application Data

(60) Provisional application No. 62/701,315, filed on Jul. 20, 2018.

(51) Int. Cl.

| | |
|---|---|
| ***D04B 1/24*** | (2006.01) |
| ***A43B 1/04*** | (2006.01) |
| ***A43B 23/02*** | (2006.01) |

(52) U.S. Cl.

CPC ..... *D04B 1/24* (2013.01); *A43B 1/04* (2013.01); *A43B 23/025* (2013.01); *A43B 23/027* (2013.01); *A43B 23/0235* (2013.01); *A43B 23/0275* (2013.01)

(58) Field of Classification Search

CPC . D04B 1/24; D04B 1/102; D04B 1/22; D04B 7/30; A43B 1/04; A43B 23/0235; A43B 23/24

See application file for complete search history.

(56) References Cited

U.S. PATENT DOCUMENTS

| | | | | |
|---|---|---|---|---|
| 4,756,098 | A * | 7/1988 | Boggia | A43B 5/00 36/114 |
| 4,785,558 | A * | 11/1988 | Shiomura | A43B 1/04 36/114 |
| 4,813,158 | A * | 3/1989 | Brown | A43B 5/00 36/114 |
| 8,266,827 | B2 * | 9/2012 | Dojan | A43B 23/025 36/45 |
| 9,924,757 | B2 * | 3/2018 | Droege | A43B 3/0089 |
| 10,092,058 | B2 * | 10/2018 | Droege | A43B 1/04 |
| 2014/0130270 | A1 | 5/2014 | Baudouin et al. | |
| 2018/0146745 | A1 | 5/2018 | Follet et al. | |

OTHER PUBLICATIONS

International Search Report and Written Opinion of the International Searching Authority for International Patent Application No. PCT/US2019/041162 dated Sep. 6, 2019; 15 pages.

International Preliminary Report on Patentability received for PCT Patent Application No. PCT/US2019/041162, dated Feb. 4, 2021, 9 pages.

Intention to Grant received for European Patent Application No. 19745525.6, dated Sep. 6, 2021, 5 pages.

* cited by examiner

*Primary Examiner* — Danny Worrell

(74) *Attorney, Agent, or Firm* — Shook, Hardy & Bacon L.L.P.

(57) ABSTRACT

An article of footwear provides improved stability and support by incorporating a strap to overlay over an instep area of an upper component that is comprised of a knitted material. The strap includes engagement members on an underside of the strap that engage ribbing structures that are part of the knitted material on an outer surface of the instep area. By engaging with the ribbing structures, the strap provides improved stability and support.

20 Claims, 8 Drawing Sheets

ARTICLE OF FOOTWEAR INCORPORATING KNITTED COMPONENTS AND A RECEIVING STRAP COMPONENT

RELATED APPLICATIONS

This application claims the benefit of U.S. Provisional Application No. 62/701,315, filed Jul. 20, 2018, the entirety of which is incorporated herein by reference.

BACKGROUND

The present disclosure generally describes articles of footwear, and, in particular, articles of footwear incorporating knitted components and a strap component for overlaying and interacting with the knitted components.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole may include a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear.

A variety of material elements (e.g., textiles, polymer foam, polymer sheets, leather, synthetic leather) are conventionally utilized in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements.

By decreasing the number of material elements utilized in the upper, therefore, waste may be decreased while increasing the manufacturing efficiency and recyclability of the upper.

DETAILED DESCRIPTION

The following discussion and accompanying figures disclose a variety of concepts relating to knitted components and the manufacture of knitted components. Although the knitted components may be used in a variety of products, an article of footwear that incorporates one or more of the knitted components is disclosed below as an example. In addition to footwear, the knitted component may be used in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted component may also be used in bed coverings (e.g., sheets, blankets), table coverings, towels, flags, tents, sails, and parachutes. The knitted component may be used as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted component and other concepts disclosed herein may be incorporated into a variety of products for both personal and industrial purposes.

Various configurations of an article of footwear may have an upper and a sole structure secured to the upper. The upper may incorporate a knitted component, as well as a securing component such as a lacing system and/or a strap. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear.

Similar to the lacing system, the strap permits the wearer to modify certain dimensions of the upper, particularly girth, to accommodate feet with varying dimensions. The strap may be made of a non-knit material (e.g., neoprene), and configured to stretch and overlay over the knitted component before being secured in place. When both the lacing system and the strap are incorporated into the upper, the strap may be incorporated to overlay over the lacing system. The upper may further incorporate a heel counter to limit movement of the heel.

Figure 1:
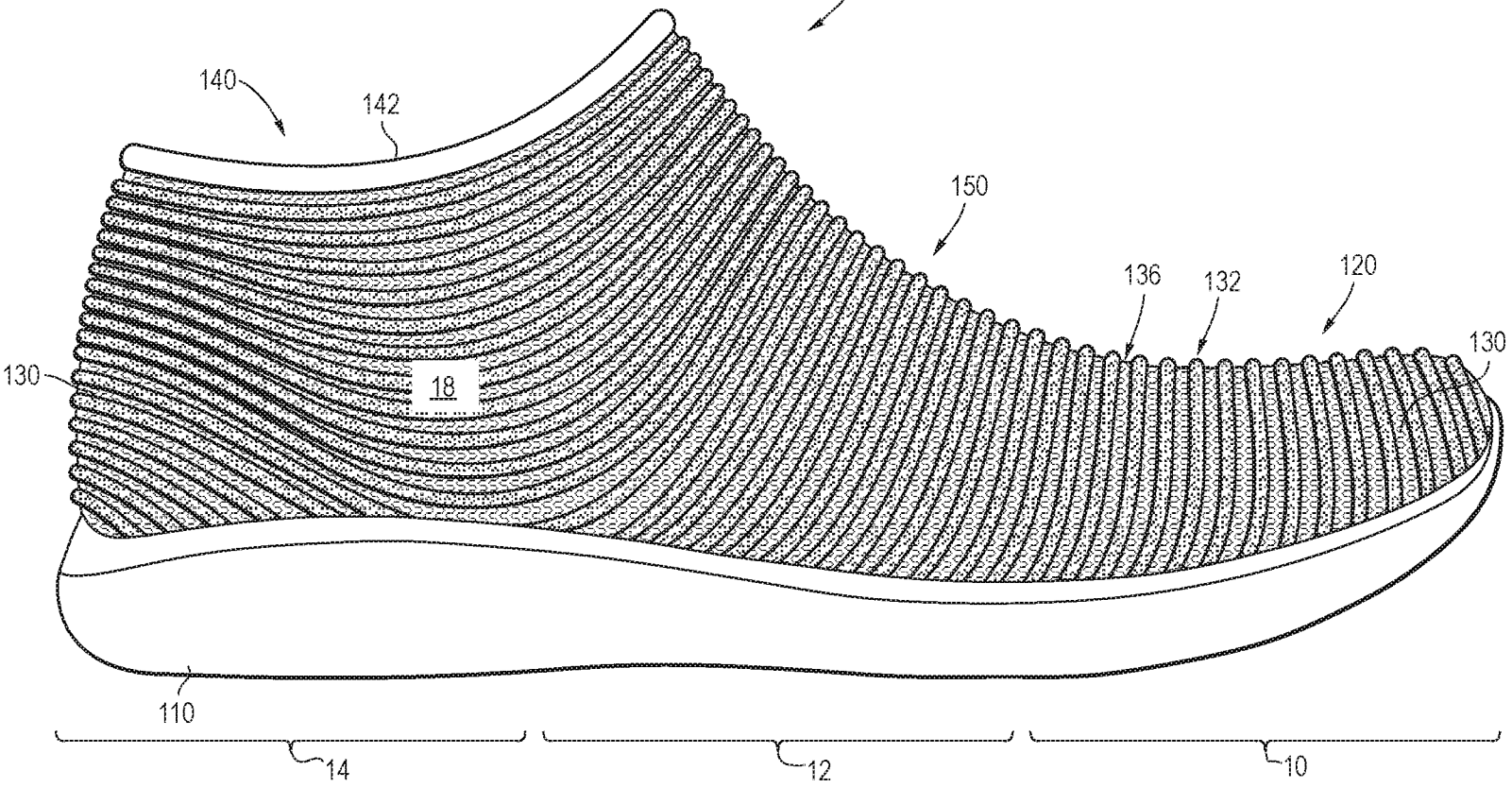
FIG. 1 shows a medial side view of the exemplary embodiment of an article of footwear incorporating a knitted component having ribbing structures.
Figure 2:
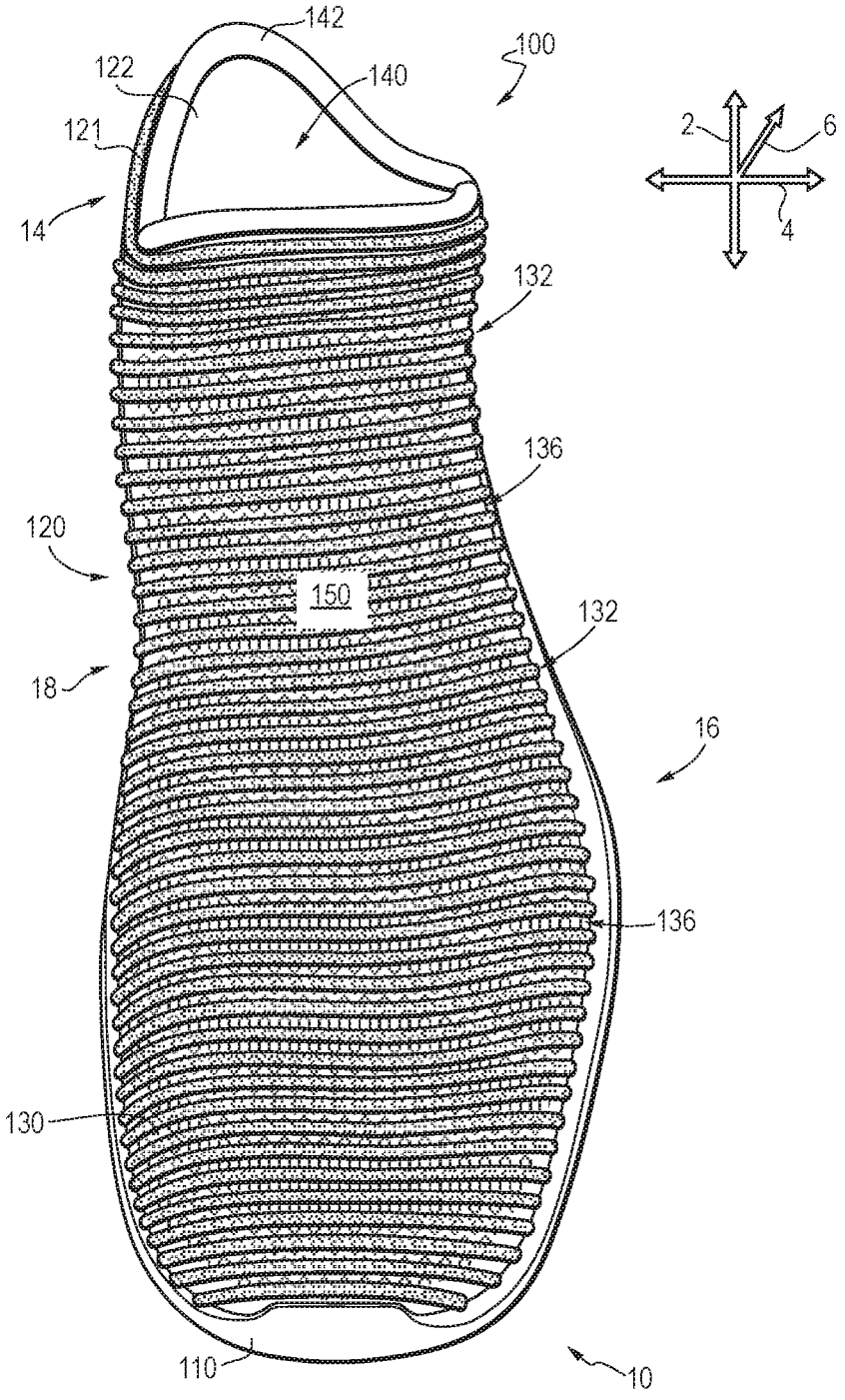
FIG. 2 shows a top front view of the exemplary embodiment of an article of footwear incorporating a knitted component having ribbing structures.

FIGS. 1 to 2 illustrate an exemplary embodiment of an article of footwear 100, also referred to simply as the article 100. In some embodiments, the article of footwear 100 may include a sole structure 110 and an upper 120. Although the article 100 is illustrated as having a general configuration suitable for running, concepts associated with the article 100 may also be applied to a variety of other athletic footwear types, including soccer shoes, baseball shoes, basketball shoes, cycling shoes, football shoes, tennis shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

For reference purposes, article 100 may be divided into three general regions: a forefoot region 10, a midfoot region 12, and a heel region 14, as generally shown in FIG. 1. Forefoot region 10 generally includes portions of the article 100 corresponding with the toes and the joints connecting the metatarsals with the phalanges. The midfoot region 12 generally includes portions of the article 100 corresponding with an arch area of the foot. The heel region 14 generally corresponds with rear portions of the foot, including the calcaneus bone. Article 100 also includes a lateral side 16 and a medial side 18, which extend through each of the forefoot region 10, the midfoot region 12, and the heel region 14 and correspond with opposite sides of the article 100. More particularly as shown in FIG. 2, the lateral side 16 corresponds with an outside area of the foot (i.e., the surface that faces away from the other foot), and the medial side 18 corresponds with an inside area of the foot (i.e., the surface that faces toward the other foot). The forefoot region 10, the midfoot region 12, and the heel region 14, and the lateral side 16, the medial side 18, are not intended to demarcate precise areas of the article 100. Rather, the forefoot region 10, the midfoot region 12, and the heel region 14 and the lateral side 16, the medial side 18 are intended to represent general areas of the article 100 to aid in the following discussion. In addition to the article 100, the forefoot region 10, the midfoot region 12, and the heel region 14 and the lateral side 16, the medial side 18 may also be applied to the sole structure 110, the upper 120, and individual elements thereof.

An exemplary coordinate system for describing the embodiment of the article 100 shown in FIGS. 1 and 2 is illustrated in FIG. 2, where a longitudinal direction 2 extends along article 100 between the forefoot region 10 to the heel region 14 of the article 100, a lateral direction 4 extends along the article 100 between the lateral side 16 and the medial side 18, and a vertical direction 6 extends along the article 100 between the sole structure 110 and a top of the article 100.

In an exemplary embodiment, the sole structure 110 is secured to the upper 120 and extends between the foot and the ground when the article 100 is worn. In some embodiments, the sole structure 110 may include one or more components, including a midsole, an outsole, and/or a sockliner or insole. In an exemplary embodiment, the sole structure 110 may include an outsole that is secured to a lower surface of the upper 120 and/or a base portion configured for securing the sole structure 110 to the upper 120. In one embodiment, outsole may be formed from a wear-resistant rubber material that is textured to impart traction. Although this configuration for the sole structure 110 provides an example of a sole structure that may be used in connection with the upper 120, a variety of other conventional or nonconventional configurations for the sole structure 110 may also be used. Accordingly, in other embodiments, the features of the sole structure 110 or any sole structure used with the upper 120 may vary.

For example, in other embodiments, the sole structure 110 may include a midsole and/or a sockliner. A midsole may be secured to a lower surface of an upper and in some cases may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

In some embodiments, the upper 120 defines a void within the article 100 for receiving and securing a foot relative to the sole structure 110. The void is shaped to accommodate the foot and extends along a lateral side of the foot, along a medial side of the foot, over the foot, around the heel, and under the foot. The upper 120 includes an exterior surface 121 and an opposite interior surface 122. Whereas the exterior surface 121 faces outward and away from the article 100, the interior surface 122 faces inward and defines a majority or a relatively large portion of the void within the article 100 for receiving the foot. Moreover, the interior surface 122 may lay against the foot or a sock covering the foot.

The upper 120 may also include a collar 142 that is located in at least the heel region 14 and forms a throat opening 140. Access to the void is provided by the throat opening 140. More particularly, the foot may be inserted into the upper 120 through the throat opening 140 formed by the collar 142, and the foot may be withdrawn from the upper 120 through the throat opening 140 formed by the collar 142. In some embodiments, an instep area 150 extends forward from the collar 142 and the throat opening 140 in the heel region 14 over an area corresponding to an instep of the foot in the midfoot region 12 to an area adjacent to the forefoot region 10.

In some embodiments, the upper 120 may include a throat portion disposed between the lateral side 16 and the medial side 18 of the upper 120 through the instep area 150. In an exemplary embodiment, the throat portion may be integrally attached to and formed of a single integral knit construction with portions of the upper 120 along lateral and medial sides through the instep area 150. Accordingly, as shown in the FIGS. 1 and 2, the upper 120 may extend substantially continuously across the instep area 150 between the lateral side 16 and the medial side 18. In other embodiments, the throat portion may be disconnected along lateral and medial sides through the instep area 150 such that the throat portion is moveable within an opening between a lateral portion and a medial portion on opposite sides of the instep area 150, thereby forming a tongue.

In further configurations, the upper 120 may include fewer elements, or include additional elements such as (a) a heel counter in heel region 14 that enhances stability, (b) a toe guard in forefoot region 10 that is formed of a wear-resistant material, and (c) logos, trademarks, and placards with care instructions and material information. As described, according to some embodiments a configuration of the upper 120 may further include elements (e.g., lace receiving loops) for incorporating a lace system into the article 100.

Many conventional footwear uppers are formed from multiple material elements (e.g., textiles, polymer foam, polymer sheets, leather, synthetic leather) that are joined through stitching or bonding, for example. In contrast, in some embodiments, a majority of the upper 120 is formed from a knitted component 130, which will be discussed in more detail below. Knitted component 130 may, for example, be manufactured through a flat knitting process and extends through each of the forefoot region 10, the midfoot region 12, and the heel region 14, along both the lateral side 16 and the medial side 18, over the forefoot region 10, and around the heel region 14. In an exemplary embodiment, knitted component 130 forms substantially all of the upper 120, including the exterior surface 121 and a majority or a relatively large portion of the interior surface 122, thereby defining a portion of the void within the upper 120. In some embodiments, the knitted component 130 may also extend under the foot. In other embodiments, however, a strobel sock or thin sole-shaped piece of material is secured to the knitted component 130 to form an attachment portion of the upper 120 that extends under the foot for attachment with the sole structure 110.

Although seams may be present in the knitted component 130, a majority of the knitted component 130 has a substantially seamless configuration. Moreover, the knitted component 130 may be formed as an integral knit construction. As utilized herein, a knitted component (e.g., knitted component 130) is defined as being formed as an integral one-piece element during a single knitting process, such as a weft knitting process (e.g., with a flat knitting machine or circular knitting machine), a warp knitting process, or any other suitable knitting process. That is, the knitting process on the knitting machine may substantially form the knit structure of the knitted component 130 without the need for significant post-knitting processes or steps. Alternatively, two or more portions of the first knitted component 130 may be formed separately as distinct integral one-piece elements and then the respective elements attached. In some embodiments (not shown), it is contemplated that a single knitted component may be included (e.g., where the knitted component 130 is comprised of two or more separate knitted components secured together), and that the single knitted component may form the majority of or the entirety of the upper 120.

The integral knit construction may be used to form a knitted component having structures or elements that include one or more courses of yarn, strands, or other knit material that are joined such that the structures or elements include at least one course in common (i.e., sharing a common yarn) and/or include courses that are substantially continuous between each of the structures or elements. With this arrangement, a one-piece element of integral knit construction is provided.

Although portions of the knitted component 130 may be joined to each other (e.g., edges of knitted component 130 being joined together) following the knitting process, the knitted component 130 remains formed of integral knit construction because it is formed as a one-piece knit element. Moreover, the knitted component 130 remains formed of integral knit construction when other elements (e.g., a lace, logos, trademarks, placards with care instructions and material information, structural elements) are added following the knitting process.

In different embodiments, any suitable knitting process may be used to produce the knitted component 130 formed of integral knit construction, including, but not limited to a warp knitting or a weft knitting process, including a flat knitting process or a circular knitting process, or any other knitting process suitable for providing a knitted component. Examples of various configurations of knitted components and methods for forming the knitted component 130 with integral knit construction are disclosed in one or more of U.S. Pat. Nos. 6,931,762; 7,347,011; 8,490,299; and 8,839,532, the disclosures of which are hereby incorporated by reference in their entirety. In an exemplary embodiment, a flat knitting process may be used to form the knitted component 130, as will be described in more detail.

Knitted component 130 may be manufactured with the configurations described above using a suitable machine, implement, and technique. For example, in some embodiments, the knitted component 130 may be automatically manufactured using a knitting machine, such as the knitting machine 700 shown in FIG. 7. Knitting machine 700 can be of any suitable type, such as a flat knitting machine. However, it will be appreciated that the knitting machine 700 could be of another type in different embodiments without departing from the scope of the present disclosure.

Figure 7:
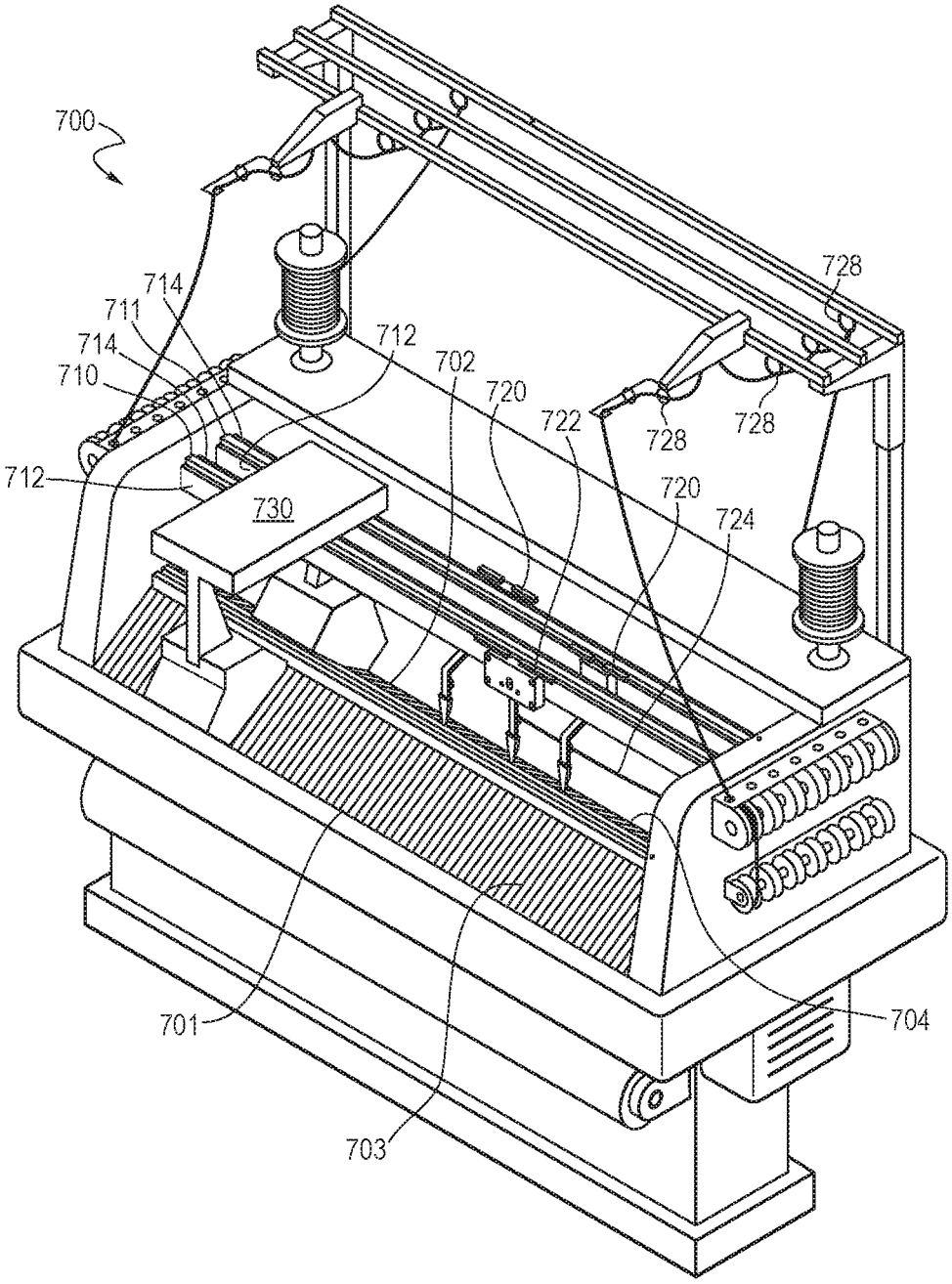
FIG. 7 shows a schematic perspective view of an embodiment of a knitting machine configured for manufacturing a knitted component.

As shown in the embodiment of FIG. 7, the knitting machine 700 may include a front needle bed 701 with a plurality of front needles 703 and a rear needle bed 702 with a plurality of rear needles 704. The front needles 703 may be arranged in a common plane, and the rear needles 704 may be arranged in a different common plane that intersects the plane of the front needles 703. The front needle bed 701 and the rear needle bed 702 may be angled with respect to each other. In some embodiments, the front needle bed 701 and the rear needle bed 702 may be angled so they form a V-bed. Knitting machine 700 may further include one or more feeders that are configured to move over the front needle bed 701 and the rear needle bed 702. In FIG. 7, a first type of feeder 720 and a second type of feeder 722 are indicated. Knitting machine 700 further includes a carriage 730 that moves across the needle beds and assists with moving the feeders relative to the needle beds. In this embodiment, the knitting machine 700 is illustrated with a plurality of first type of feeder 720 and at least one of second type of feeder 722. As the first type of feeder 720 moves, the feeder 720 can deliver yarn to the front needles 703 and/or the rear needles 704 for one or more of knitting, tucking, or floating using the yarn to form a knitted component, including the knitted component 130. As the second type of feeder 722 moves, the second type of feeder 722 can deliver a yarn to the front needles 703 and/or rear needles 704 for one or more of knitting, tucking, or floating. In some embodiments, the second type of feeder 722 may be a combination feeder that may additionally be configured to inlay a yarn. In an exemplary embodiment, the second type of feeder 722 may deliver a tensile element 724 to be inlaid within the knitted component 130.

A pair of rails, including a forward rail 710 and a rear rail 711, may extend above and parallel to the intersection of the front needle bed 701 and the rear needle bed 702. Rails may provide attachment points for feeders. The forward rail 710 and the rear rail 711 may each have two sides, including a front side 712 and a back side 714. Each of the front side 712 and the back side 714 may accommodate one or more feeders. As depicted, the rear rail 711 includes two of feeders 720 on opposite sides, and the forward rail 710 includes the feeder 722. Although two rails are depicted, further configurations of knitting machine 700 may incorporate additional rails to provide attachment points for more feeders.

Feeders can move along the forward rail 710 and the rear rail 711, thereby supplying yarns to needles. As shown in FIG. 7, yarns are provided to a feeder by one or spools that route yarns through yarn guides 728 to the feeders for knitting. Although not depicted, additional spools may be used to provide yarns to feeders in a substantially similar manner. A suitable knitting machine including conventional and combination feeders for the knitting machine 700, as well as the associated method of knitting using the machine to form knitted components, is described in U.S. Pat. No. 8,522,577, the disclosure of which is hereby incorporated by reference in its entirety.

Figure 8:
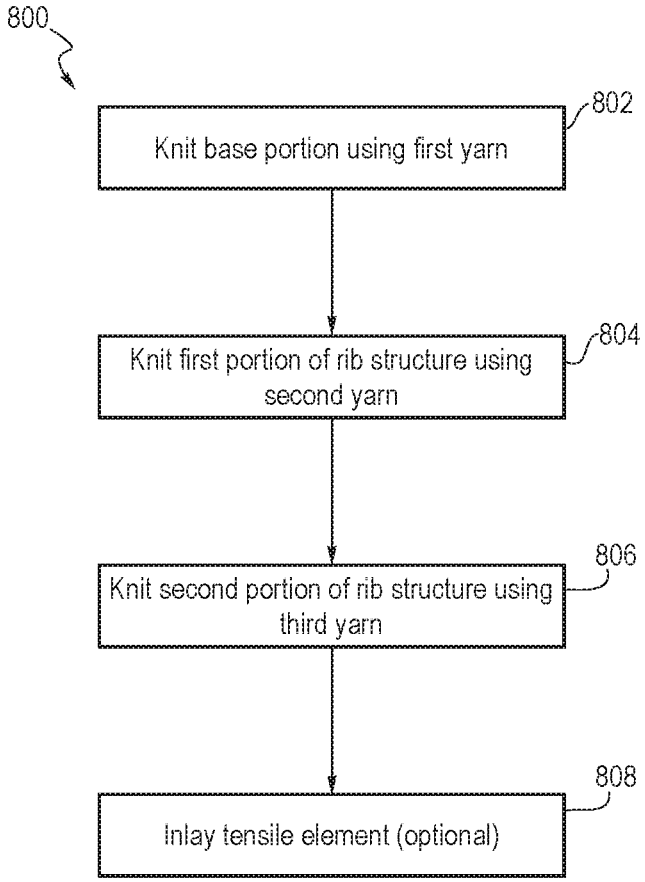
FIG. 8 shows a flowchart of an exemplary process for knitting a knitted component having ribbing structures.

FIG. 8 illustrates an exemplary process 800 for knitting a knitted component to include ribbing structures 132, including the knitted component 130. The ribbing structures 132 are raised portions on the knitted component 130 when compared to adjacent base portions 136 that are relatively lower on the knitted component 130. The ribbing structures 132 are also knitted to have a tubular rib structure. The tubular rib structure form a hollow enclosure that allows for an additional component (e.g., support wires or plastic tubing) to be inserted within to provide increased structural strength. The tubular rib structure may otherwise be referred to as a "welt" construction. According to some embodiments, the ribbing structures 132 may be knitted to have increased structural strength by using, for example, a thicker or wider yarn, varying yarn materials, and/or different knitting structure that results in a denser knitting configuration. Denser knitting configuration may be achieved by a tighter knit, more knit loops per given area (e.g., square cm), or other known methods.

In one embodiment, process 800 may include one or more steps that may be repeated to form a completed knitted component. The order of the steps is exemplary, and in other embodiments, additional or different steps not shown in FIG. 8 may be included to knit a knitted component. At a first step 802, a base portion 136 of the knitted component 130 may be knit using a first yarn. Next, at step 804, a first portion of the tubular rib structure forming the ribbing structures 132 may be knit using a second yarn. At a step 806, a second portion of the tubular rib structure forming the ribbing structures 132 may be knit using a third yarn. As noted above, in exemplary embodiments, the second yarn used at step 804 and the third yarn used at step 806 may be different types of yarn, including yarns having different characteristics, including, but not limited to: width, thickness, material composition, texture, threading pattern, or other qualities, which may contribute to provide the increased structural strength properties to the ribbing structures 132 of the knitted component 130.

In some embodiments, the first yarn used at step 802 to form base portion 136 may be different from one or both of the second yarn and the third yarn. In other embodiments, the first yarn used at step 802 may be similar to either of the second yarn and the third yarn.

Figure 6:
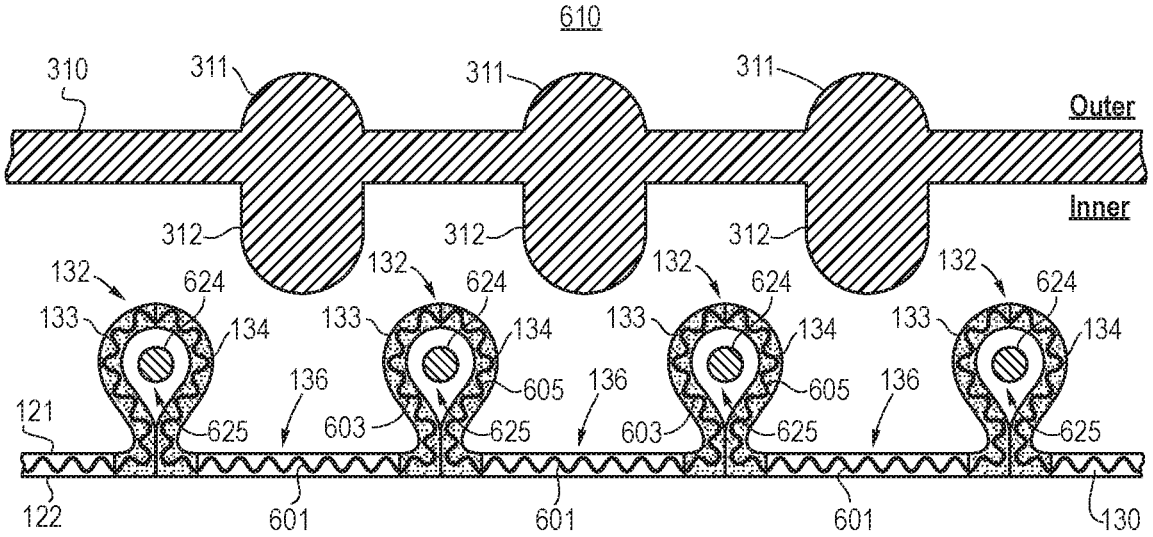
FIG. 6 shows a first representative view of a first embodiment for an overlaying strap interacting with a knitted component having ribbing structures, and a second representative view of a second embodiment for an overlaying strap interacting with a knitted component having ribbing structures.
Figure 6:
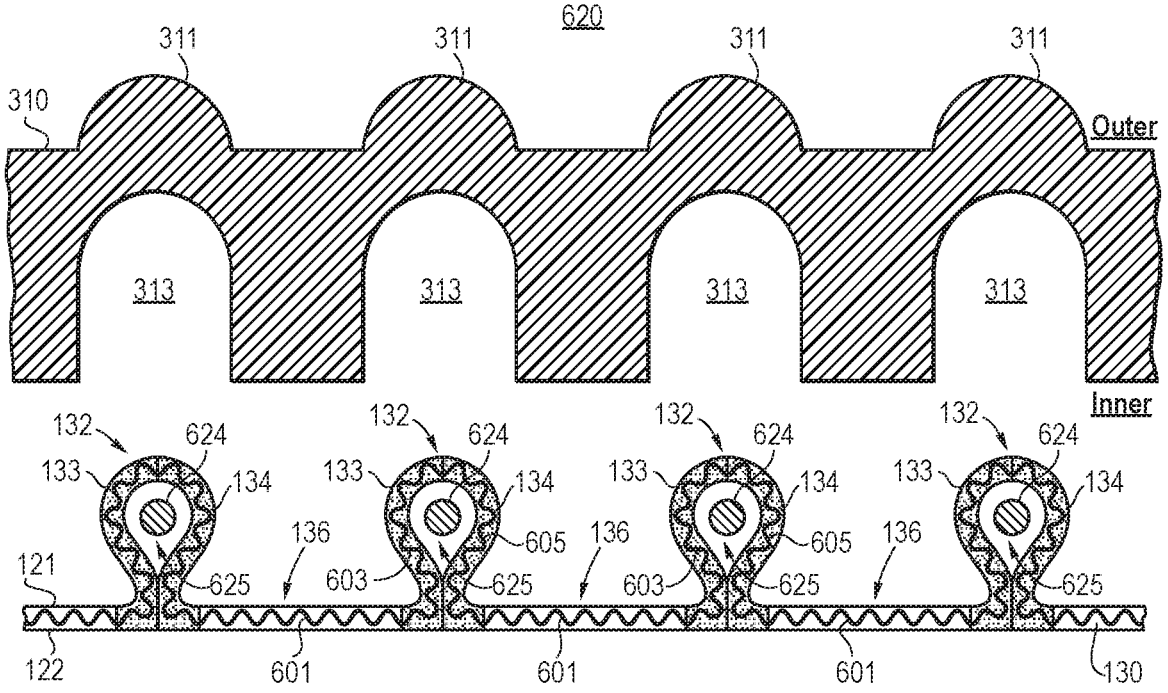

In some embodiments, tensile elements 624, as shown in FIG. 6, may be incorporated, inlaid, or extended into one or more tubular rib structures during the integral knit construction of the knitted component 130. Stated another way, tensile elements 624 may be incorporated during knitting process 800 of knitted component 130. As shown in FIG. 8, process 800 may include an optional step 808 to inlay a tensile element within one or more of the tubular rib structures forming the ribbing structures 132. In some embodiments, the tensile elements 624 may lie within unsecured areas forming tunnels within the tubular rib structures of the ribbing structures 132. In different embodiments, one or more tensile elements 624 may be incorporated in the knitted component 130. For example, in embodiments where the upper 120 includes a lacing system, the tensile element 624 may be used to form lace receiving member that form loops to receive lace in the lacing system. Tensile elements 624 may also provide support to the knitted component 130 by resisting deformation, stretching, or otherwise providing support for the wearer's foot during running, jumping, or other movements.

With this configuration, process 800 may be used to form a plurality of base portions 136 and a plurality of ribbing structures 132 disposed throughout a portion or a substantial majority of the knitted component 130 to be incorporated into upper 120 for article 100.

Generally, the base portions 136 of the knitted component 130 may be connecting portions between various elements and/or components of knitted component 130. For example, the base portions 136 may extend between one tubular rib structure and another adjacent tubular rib structure forming the ribbing structures 132. In addition or alternatively, the base portions 136 may also extend between one tubular rib structure and another portion of the knitted component 130. In addition or alternatively, the base portions 136 may also extend between one tubular rib structure and an edge of knitted component 130. Base portions 136 are formed of integral knit construction with the remaining portions of knitted component 130 and may serve to connect various portions together as a one-piece knit element. Knitted component 130 may include any suitable number of base portions 136. In different embodiments, the base portions 136 may be an area of knitted component 130 comprising one knit layer. In some embodiments, the base portions 136 may extend between one portion of knitted component and another portion of the knitted component 130. Suitable configurations of the base portions 136 may be in the form of a webbed area described in U.S. Pat. No. 9,375,046, the disclosure of which is hereby incorporated by reference in its entirety.

As described above, in some embodiments the ribbing structures 132 may be formed as tubular rib structures that are areas of the knitted component 130 constructed with two or more co-extensive and overlapping knit layers. Knit layers may be portions of knitted component 130 that are formed by knitted material, for example, threads, yarns, or strands, and two or more knit layers may be formed of integral knit construction in such a manner so as to form tubes or tunnels, identified as tubular rib structures, in the knitted component 130. Although the sides or edges of the knit layers forming the tubular rib structures may be secured to the other layer, a central area is generally unsecured to form a hollow between the two layers of knitted material forming each knit layer. In some embodiments, the central area of the tubular rib structures may be configured such that another element (e.g., a tensile element) may be located between and pass through the hollow between the two knit layers forming the tubular rib structures. Suitable tubular rib structures, including with or without inlaid tensile elements, that may be used to form the ribbing structures 132 are described in U.S. Pat. No. 9,375,046.

Figure 3:
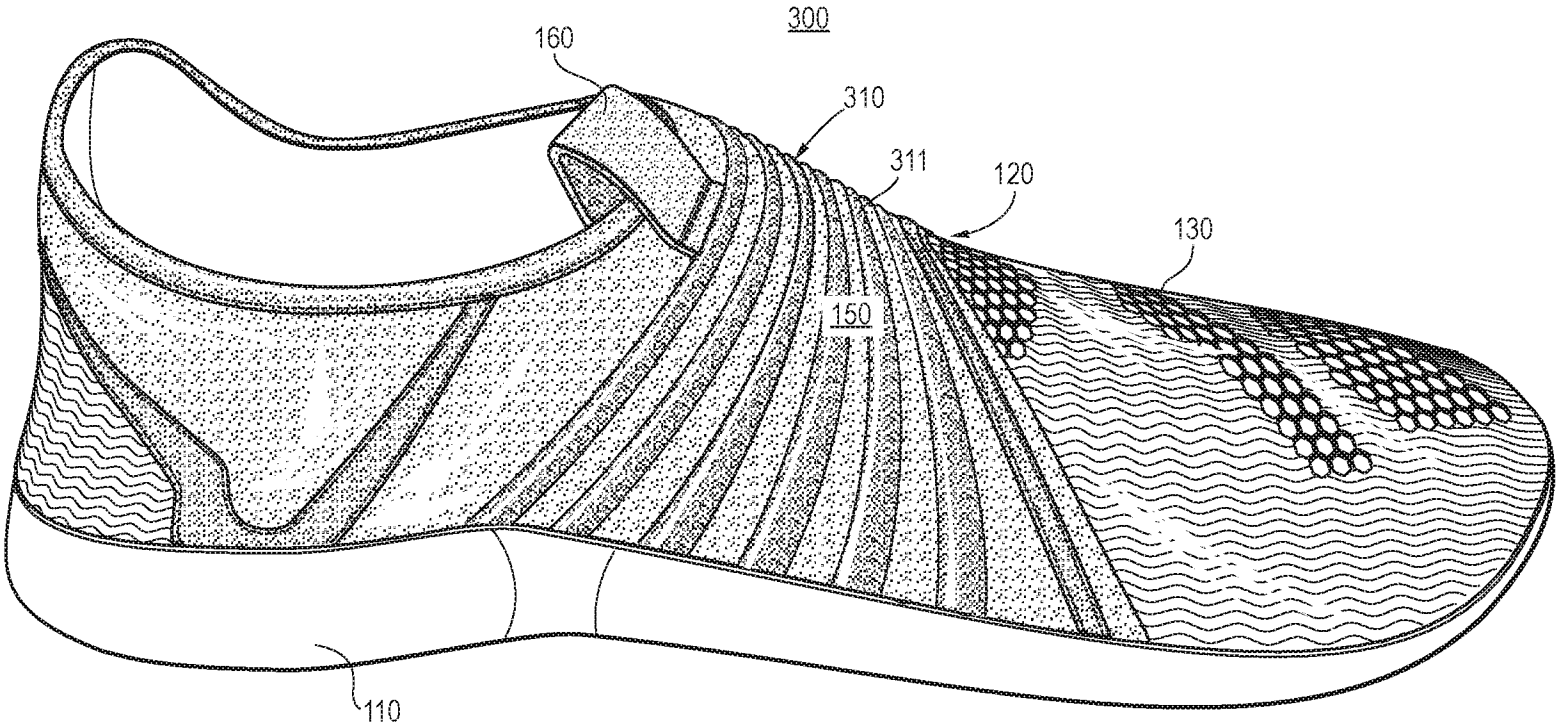
FIG. 3 shows a lateral side view of the exemplary embodiment of an article of footwear incorporating a knitted component having ribbing structures and an overlaying strap for interacting with the ribbing structures.

Referring now to FIG. 3, a lateral view of an exemplary article 300 is shown according to some embodiments. The exemplary article 300 includes the sole structure 110, as well as the upper 120 formed from the knitted component 130.

In addition, the exemplary article 300 includes a strap 310 formed from a non-knitted material (e.g., neoprene), where the strap 310 overlays over the instep area of the upper 120. The strap 310 is attached to the sole structure 110 in a same, or similar, manner as the upper 120 is attached to the sole structure 110. For example, the strap 310 may include attachment portions that extend under the foot for attachment with the sole structure 110. The strap 310 includes a plurality of ribs 311 on an outer surface visible in FIG. 3. Further description of the ribs 311 formed on the outer surface of the strap 310, as well engagement members that are formed on an inner surface of the strap 310, is provided with reference to FIG. 6.

According to some embodiments, the strap 310 may also be knitted either as an integral extension to the knitted component 130, or as a separate knitted piece from the knitted component 130. For example, the strap 310 may be constructed as a second layer knitted integrally with the rest of the upper 120. In such embodiments, the strap 310 may be one layer formed on one needle bed of the knitting machine 700, while the instep area 150 is a second layer formed with a second needle bed of the knitting machine 700, wherein the two layers are secured at or around a biteline, where the upper 120 meets the sole structure 110 for attachment.

Figure 4:
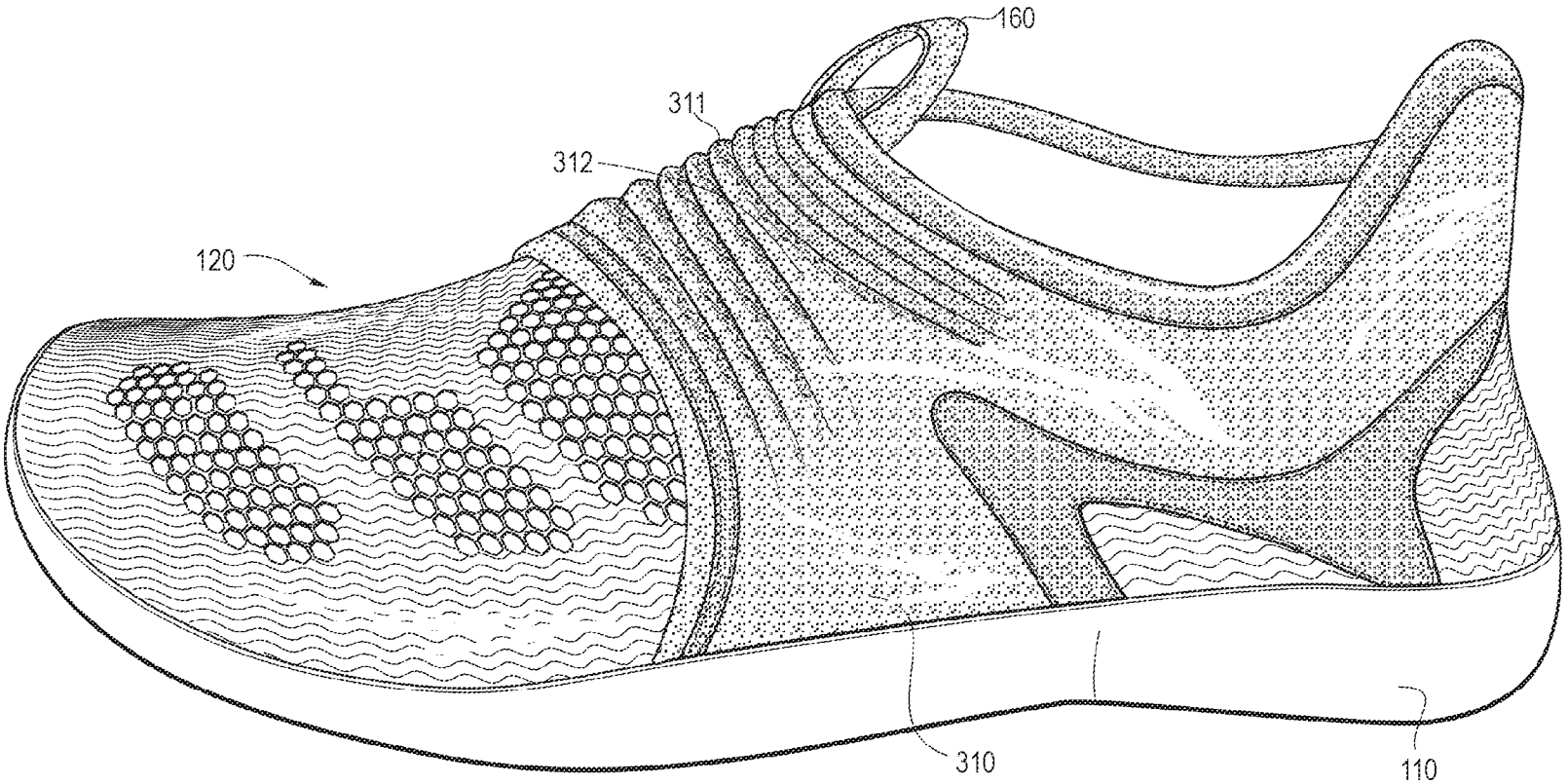
FIG. 4 shows a medial side view of the exemplary embodiment of an article of footwear incorporating a knitted component having ribbing structures and an overlaying strap for interacting with the ribbing structures.

Also shown in FIG. 3 is a knit tab portion 160, that is a part of the upper 120 that is secured to a collar area of the strap 310. The knit tab portion 160 is also shown in the medial view of the exemplary article 300 shown in FIG. 4. In FIG. 4 the knit tab portion 160 is shown to form a loop as the knit tab portion 160 is secured to the strap 310. The knit tab portion 160 may be stitched, fused (e.g., heat bonded), or otherwise secured to the strap 310 by known techniques.

Figure 5:
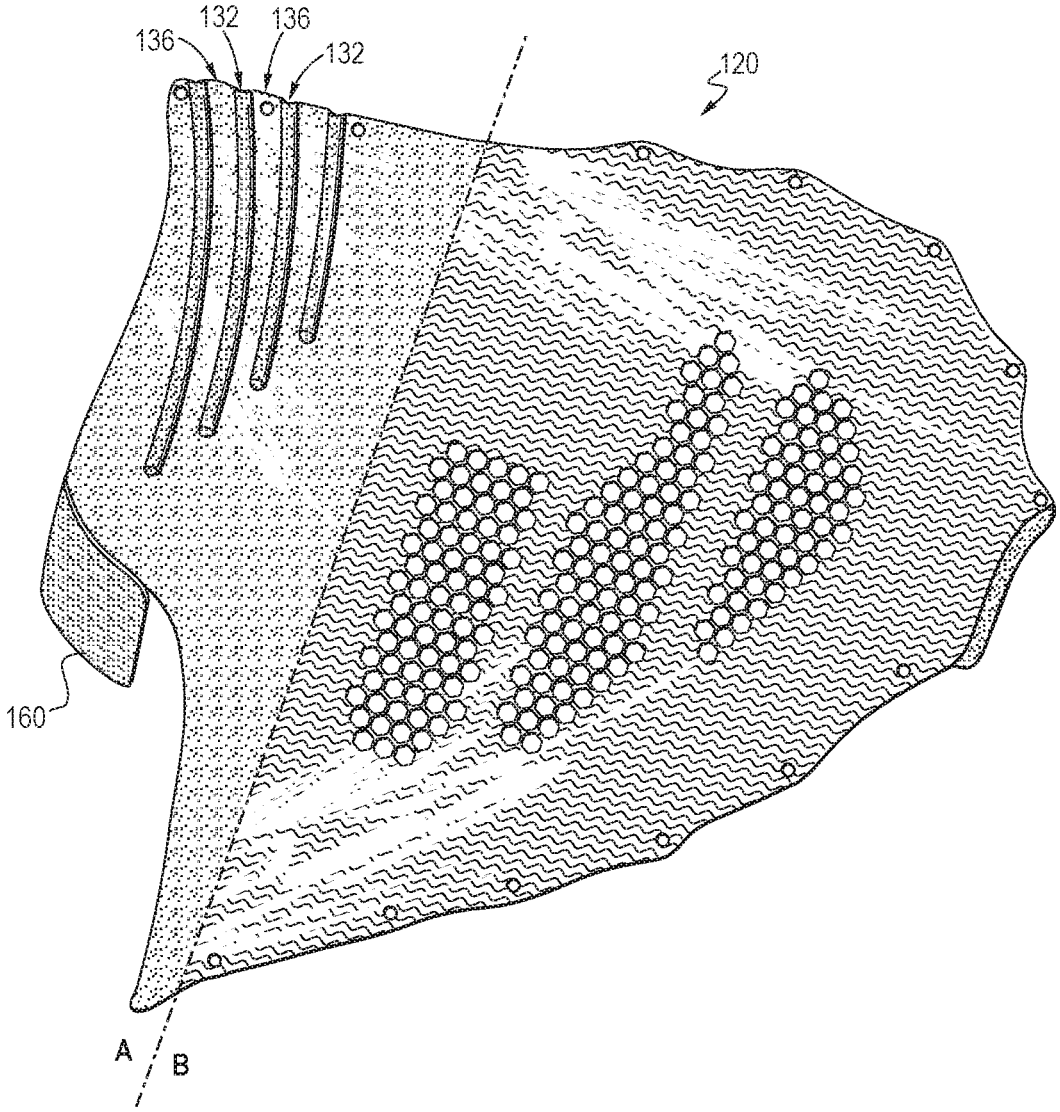
FIG. 5 shows a portion of a knitted component having ribbing structures and an upper tab for attaching to an overlaying strap.

FIG. 5 shows a portion of the knitted component 130 in a laid out state without being attached to the sole structure 110. In FIG. 5, the portion of the knitted component 130 more clearly shows the knit tab portion 160 that is provided on the knitted component 130 to be secured to the collar area of the strap 310.

According to the embodiments represented by FIG. 5, the material composition of the knitted component 130 in the forefoot region 10 (identified as portion B) may be more rigid than in the regions above the forefoot region 10 such as the instep area 150 (identified as portion A). Said another way, the material composition of the knitted component 130 in the instep area 150 may be more elastic compared to the forefoot region 10. The elasticity may be measured in terms of a modulus of elasticity (elastic modulus), where the unit of measurements may be in terms of pressure (e.g., pascal (Pa)), tensile strength (e.g., unit of force per unit area ($N/m^2$), or elongation (e.g., measured as a percentage (%) of itself the yarn is able to elongate/stretch). The yarn used in the instep area 150 may, for example, have an elongation of 180-250%. The elasticity may be measured based on a standard elasticity test such as, for example, an elongation test.

The increased rigidity in the forefoot region 10, relative to the instep area 150, may be achieved by a specific material composition of the yarn used. For example, the yarn used to create the knitted composition 130 in the forefoot region 10 may include any combination of a polyester-based yarn alone, or combined with a thermoplastic polymer (TPU) material, or use of a TPU-based yarn. The increased rigidity may also be achieved through knitting techniques (e.g., tighter knitting), or other properties of the yarn (e.g., wider or thicker yarn). The increased rigidity in the forefoot region 10 corresponds to the region surrounding a wearer's toes. Therefore, the increased rigidity results in increased structural strength and rigidness, which provides the wearer with more stability and protection compared to a more elastic material. The rigidness may be measured in terms of a modulus of rigidity (rigidity modulus), where the measurement of rigidity is made in terms of tension, flexure, or compression. An exemplary unit of measurement for rigidity is Newtons per meter (N/m). The rigidity modulus may be measured based on a known standards rigidity test such as, for example, the ASTM standards test or ISO standards test. The rigidity of the material may also be characterized by a lower elasticity. For example, the yarn used in the forefoot region 10 may have an elongation of 20-40%, which is comparatively less when compared to the elongation of 180-250% in the instep area 150.

The increased elasticity in the instep area 150, relative to the forefoot region 10, may be achieved by a specific material composition of the yarn used. For example, the yarn used to create the knitted composition 130 in the instep area 150 may include any combination of a polyester-based yarn alone, or combined with a spandex-based material, or use of a spandex-based yarn. A spandex-based yarn may be comprised of strands of polyester yarns wrapped around a spandex thread. The increased elasticity may also be achieved through knitting techniques (e.g., looser knitting), or other properties of the yarn (e.g., narrower or thinner yarn). As these regions surround the throat area for receiving entry of the wearer's foot, the elastic material provides enhanced comfort to better facilitate foot entry into the throat area.

Referring now to FIG. 6, a first representational view 610 showing a first embodiment of the strap 310 that includes protruding engagement members 312 formed on the inner surface of the strap 310 for engaging the ribbing structures 132 of the upper 120. The first representational view 610 also shows a portion of the knitted component 130 incorporating the ribbing structures 132 including hollow unsecured areas 625 that hold tensile elements 624. Also shown in FIG. 6 is a second representational view 620 showing a second embodiment of the strap 310 that includes inverted engagement members 313 formed on the inner surface of the strap 310 for engaging the ribbing structures 132 of the upper 120.

As shown in FIG. 6, each of the ribbing structures 132 includes a first portion 133 formed using a second yarn 603 and a second portion 134 formed using third yarn 605. Although FIG. 6 is illustrated to show the second yarn 603 and the third yarn 605 being different, according to other embodiments the second yarn 603 and the third yarn 605 may be the same, or substantially similar. In an exemplary embodiment, at least one course of first portion 133 formed with the second yarn 603 is interlooped with at least one course of second portion 134 formed with the third yarn 605.

With this configuration, the first portion 133 and second portion 134 are formed of integral knit construction. Spaced between and separating each of the ribbing structures 132 are the base portion 136 of the knitted component 130. The base portion 136 is formed from a first yarn 601, as described above, and is also formed of integral knit construction with first portion 133 and second portion 134 on respective sides of the ribbing structures 132.

In the embodiments shown in FIG. 6, each of the ribbing structures 132 include a tensile element 624 extending through the unsecured area 625 of the tubular rib structure forming the ribbing structures 132. In FIG. 6, each of the ribbing structures 132 includes an accompanying tensile element 624. In other embodiments, however, the tensile element 624 may be disposed in only selected ribbing structures 132 located in specific areas or regions of the knitted component 130, in other words not all of the ribbing structures 132 may include a tensile element 624. For example, as shown in FIG. 1, tensile elements 624 may be included in the ribbing structures 132 located along instep area 150 so as to provide the engagement relationship with the strap 310 disclosed herein. In still other embodiments, tensile elements 624 may be omitted.

According to the first embodiment of the strap 310, protruding engagement members 312 are formed on the inner surface of the strap 310 for engaging the ribbing structures 132 of the upper 120. Specifically, the protruding engagement members 312 are configured to come down and fit between individual ribs of the ribbing structure 132 when the strap 310 is secured down to overlay over the instep area 150 of the upper. By fitting between the individual ribs of the ribbing structure 132, the protruding engagement members 312 abut against the ribbing structure 132 to provide frictional forces for securing the strap 310 onto the ribbing structure 132 and help resist movement of the strap 310 over the ribbing structure 132.

According to the second embodiment of the strap 310, inverted engagement members 313 are formed on the inner surface of the strap 310 for engaging the ribbing structures 132 of the upper 120. Specifically, the inverted engagement members 313 are configured to come down and fit over individual ribs of the ribbing structure 132 when the strap 310 is secured down to overlay over the instep area 150 of the upper. By fitting over the individual ribs of the ribbing structure 132, the inverted engagement members 313 abut against the ribbing structure 132 to provide frictional forces for securing the strap 310 onto the ribbing structure 132 and help resist movement of the strap 310 over the ribbing structure 132.

While various embodiments, features, and benefits of the present system have been described, it will be apparent to those of ordinary skill in the art that many more embodiments, features, and benefits are possible within the scope of the disclosure. For example, other alternate systems may include any combinations of structure and functions described above or shown in the figures.

What is claimed is:

1. An article of footwear comprising:

a) a knitted component including an instep area; and b) a strap covering over the knitted component in the instep area, wherein the strap only partially overlays the knitted component, and wherein the strap includes an inner side;

wherein the knitted component comprises:

i) a knit tab portion;

ii) a ribbing structure in at least the instep area and comprising at least two ribbing members; and iii) a base portion positioned between the at least two ribbing members; and wherein the inner side comprises an engagement member in contact with the ribbing structure.

2. The article of footwear of claim 1, wherein the knit tab portion is secured to the strap.

3. The article of footwear of claim 1, wherein the ribbing structure includes a tubular rib structure.

4. The article of footwear of claim 3, wherein the tubular rib structure includes a hollow enclosure, and an elongated support member is within the hollow enclosure.

5. The article of footwear of claim 1, wherein the strap is formed of a first material and the knitted component is formed of a second material, where the first material is different from the second material.

6. The article of footwear of claim 1, wherein the engagement member protrudes out and is positioned between the at least two ribbing members comprising the ribbing structure when the strap is secured to the knitted component.

7. The article of footwear of claim 1, wherein the engagement member is an inverted shape and covers over at least one of the at least two ribbing members comprising the ribbing structure when the strap is secured to the knitted component.

8. The article of footwear of claim 1, wherein the ribbing structure in the instep area is formed by a first knitting structure and a secondary ribbing structure in a forefoot area is formed by a second knitting structure, wherein the first knitting structure has a denser knitting configuration than the second knitting structure.

9. The article of footwear of claim 1, wherein the knitted component in, at least a part, of the instep area is formed of a first composition of yarn material; and wherein the knitted component in, at least a part, of a forefoot area is formed of a second composition of yarn material, wherein the first composition of yarn material has greater elasticity than the second composition of yarn material.

10. The article of footwear of claim 1, wherein the ribbing structure in the instep area is formed of a first composition of materials and the knitted component in a forefoot area is formed of a second composition of materials, wherein the first composition of materials is different from the second composition of materials.

11. The article of footwear of claim 10, wherein the first composition of materials includes a thermoplastic material, and the second composition of materials includes spandex.

12. The article of footwear of claim 1, wherein the ribbing structure in the instep area is formed of a first composition of materials and the base portion in the instep area is formed of a second composition of materials, wherein the first composition of materials has greater rigidity than the second composition of materials.

13. The article of footwear of claim 1, wherein the ribbing structure in the instep area is formed of a first composition of materials and the base portion in the instep area is formed of a second composition of materials, wherein the first composition of materials is different from the second composition of materials.

14. The article of footwear of claim 1, wherein the knitted component further includes a mesh portion in a forefoot area.

15. The article of footwear of claim 1, wherein the strap is formed of a neoprene material.

16. The article of footwear of claim 1, wherein the strap is an additional knitted layer over the knitted component.

17. The article of footwear of claim 1, wherein the knitted component in the instep area is characterized by a greater elongation measurement compared to the knitted component in a forefoot area.

18. The article of footwear of claim 1, wherein the knitted component in a forefoot area is characterized by a greater rigidity compared to the knitted component in the instep area.

19. An article of footwear comprising:

a) a knitted component including an instep area and a forefoot area, wherein yarns comprising the knitted component in the instep area have greater elasticity than yarns comprising the knitted component in the forefoot area; and b) a strap covering over the knitted component in the instep area, wherein the strap includes an outer side and an inner side;

wherein the knitted component comprises:

i) a knit tab portion secured to the outer side;

ii) a ribbing structure in at least the instep area and comprising at least two ribbing members; and iii) a base portion positioned between the at least two ribbing members;

and wherein the inner side comprises protruding engagement member configured to fit between a first ribbing member and a second ribbing member of the ribbing structure.

20. The article of footwear of claim 19, wherein the knit tab portion is secured to the strap.

* * * * *